US008858078B2

(12) United States Patent
Vonwiller

(10) Patent No.: US 8,858,078 B2
(45) Date of Patent: Oct. 14, 2014

(54) VACUUM BAGGIE

(76) Inventor: Rene Eric Vonwiller, Conover, NC (US)

( * ) Notice: Subject to any disclaimer, the term of this patent is extended or adjusted under 35 U.S.C. 154(b) by 57 days.

(21) Appl. No.: 13/344,602

(22) Filed: Jan. 5, 2012

(65) Prior Publication Data

US 2013/0028539 A1 Jan. 31, 2013

Related U.S. Application Data

(60) Provisional application No. 61/429,871, filed on Jan. 5, 2011.

(51) Int. Cl.
*B65D 33/01* (2006.01)
*B65D 33/25* (2006.01)
*B65D 81/20* (2006.01)

(52) U.S. Cl.
CPC ..... *B65D 33/2591* (2013.01); *B65D 81/2015* (2013.01); *B65D 81/2023* (2013.01); *B65D 81/2038* (2013.01)
USPC ..... 383/100; 383/61.3; 383/64

(58) Field of Classification Search
USPC ..... 383/61.3, 64, 100
See application file for complete search history.

(56) References Cited

U.S. PATENT DOCUMENTS

| | | | | |
|---|---|---|---|---|
| 3,409,224 | A | 11/1968 | Harp et al. | |
| 5,095,717 | A | 3/1992 | Germi | |
| 5,142,970 | A * | 9/1992 | ErkenBrack | 99/472 |
| 5,261,532 | A * | 11/1993 | Fauci | 206/218 |
| 5,450,963 | A | 9/1995 | Carson | |
| 5,544,752 | A * | 8/1996 | Cox | 206/524.8 |
| 5,881,881 | A * | 3/1999 | Carrington | 206/524.8 |
| 5,996,800 | A | 12/1999 | Pratt | |
| 6,045,264 | A * | 4/2000 | Miniea | 383/41 |
| 6,085,906 | A * | 7/2000 | Lambert | 206/524.8 |
| 6,123,219 | A | 9/2000 | Cornell et al. | |
| 6,634,384 | B2 | 10/2003 | Skeens et al. | |
| 6,983,845 | B2 | 1/2006 | Shah et al. | |
| 7,290,660 | B2 | 11/2007 | Tilman et al. | |
| D558,598 | S | 1/2008 | Tilman et al. | |
| 7,337,921 | B2 | 3/2008 | Ma | |
| 7,490,452 | B2 | 2/2009 | Alipour et al. | |
| 7,972,064 | B2 | 7/2011 | Anderson | |
| 2003/0152296 | A1 * | 8/2003 | Huffer | 383/64 |
| 2004/0049896 | A1 * | 3/2004 | Savicki | 24/399 |
| 2004/0114837 | A1 | 6/2004 | Koyanagi | |
| 2005/0172577 | A1 | 8/2005 | Oltrogge | |
| 2005/0207679 | A1 * | 9/2005 | Armstrong | 383/64 |
| 2005/0259895 | A1 * | 11/2005 | Kozak | 383/61.2 |
| 2006/0008187 | A1 * | 1/2006 | Armstrong | 383/103 |
| 2008/0223005 | A1 | 9/2008 | Kim | |
| 2008/0223006 | A1 | 9/2008 | Kim | |
| 2009/0223863 | A1 | 9/2009 | Lomax et al. | |

* cited by examiner

*Primary Examiner* — Jes F Pascua
*Assistant Examiner* — Peter Helvey
(74) *Attorney, Agent, or Firm* — Monty Simmons; Simmons Patents

(57) ABSTRACT

Embodiments of the invention include a re-sealable and re-useable storage device with an integral vacuum sealing feature that can be used to create an air tight vacuum sealed environment within the storage device without a machine or pump. Embodiments of the invention further include retrofit kits for adding a vacuum sealing function to a storage device configured to provide an air tight seal but not otherwise configured to allow air to be removed from such storage device once sealed.

19 Claims, 14 Drawing Sheets

VACUUM BAGGIE

CLAIM TO PRIORITY

This application claims priority to provisional application 61/429,871, filed on Jan. 5, 2011, the entire contents the entire contents of which are incorporated by this reference for all that it discloses for all purposes.

TECHNICAL FIELD OF THE INVENTION

The present invention relates to a reusable, flexible, evacuable storage device for storing food in a vacuum sealed environment wherein the vacuum is user created without the use of a tool. Also disclosed is a vacuum accessory for retro fitting air tight storage device with a vacuum sealing capability.

BACKGROUND

Food preservation is the process of treating and handling food to stop or slow down spoilage (loss of quality, edibility or nutritional value) and thus allow for a longer shelf life. Preservation typically involves preventing the growth of bacteria, yeasts, fungi, and other micro-organisms as well as retarding the oxidation of fats. Consequently, when it comes to prolonging the freshness of food, there are two main enemies; air and temperature.

Refrigeration addresses the "temperature" issue and preserves food by lowering the storage temperature thereby slowing down the growth and reproduction of micro-organisms and the action of enzymes which cause food to rot. Freezing food in an unprepared state is commonly used to prolong "shelf life", both commercially and domestically. Under certain circumstances, however, freezing food can result in freezer burn. While not a safety risk, freezer burn appears as grayish-brown leathery spots on frozen food, and occurs when air reaches the food's surface and dries out the product. This can happen any time food is not securely wrapped in air-tight packaging.

Vacuum packing addresses the "air" issue by storing food in a vacuum environment, often in an air-tight bag or more rigid container such as a bottle. Such vacuum environment strips bacteria of oxygen needed for survival. Consequently, with regard to food preservation, the goal of vacuum packing is to remove oxygen from a container holding food thereby extending such food's shelf life within or outside a cooled environment. When a vacuum packed item is stored in a refrigerator or freezer, vacuum packing also minimizes freezer burn.

Today many products are sold to allow people to vacuum seal their own food. For prior art devices, one simply needs a sealable container and a vacuum machine that creates a vacuum to remove the air from such container. When the container is a baggie, the machine typically creates a vacuum to remove the air from the baggie and then seals the baggie; often using heat. For such prior art systems, one simply inserts food into a special plastic bag, places the open end of such bag into the slot of the vacuum machine, and presses a button. The machine quickly vacuums out all/most of the air from the bag and then heat seals the bag thereby creating a relatively long term seal allowing one to safely store the enclosed food in the refrigerator, freezer, or in a cabinet for an extended period of time.

However, often times a person may not need a long term storage process but requires a relatively less expensive and perhaps shorter term solution. For example, one may purchase a bread product that one will not eat in one setting but will likely eat over a period of a few days. One method is to store such food stuff in well-known reusable baggies that provide a releasable seal at one end. Such baggies work well for their intended purposes but do little to prolong the shelf life of the stored food. Consequently, prior art devices where developed to vacuum seal food stuff in baggies.

Prior art systems based on "single use" vacuum storage bags, such as the one taught in U.S. Pat. No. 5,048,269 (issued to Deni et. al.) evacuate air from a storage bag through the same opening through which the item to be stored is placed into the bag. The Deni et al. device then evacuates the air from the bag thereby creating a vacuum inside the bag. The Deni et al. device then "permanently" seals the baggie so that the bag must be cut open to access the item inside the bag. Such systems are well known. Should a user want to reuse such a baggie, the old seal is cut and removed from the baggie and air is evacuated through the newly cut opening and permanently sealed again (making such baggies re-useable to an extent). Such a system requires the use of tools and a power source and eventually new bags.

To address such problem, systems such as the one taught by Skeens et al. in U.S. Pat. No. 6,634,384 have been developed. Skeens et al. teach a valve assembly mounted in a resealable/reclosable storage bag. The valve assembly includes a base and a valve element. The valve element includes a stem with a convex cap attached at one end and a valve gate attached at the opposite end. When the stem is pressed down by a line associated with a vacuum, air may draw out of the baggie creating a vacuum pressure inside the baggie. As before, however, a separate device is required to interface with the vacuum port and/or generate the vacuum.

A common drawback of the above described prior art systems relates to the vacuum generating/packing apparatus. Such vacuum generating devices cost money and they either take up valuable counter top space or drawer space. Additionally, one must have access to such devices when needed which is neither always convenient nor quick. Consequently, while several prior art re-sealable vacuum bag configurations have been developed, the cost of the vacuum apparatus, need of access (i.e. a vacuum apparatus may not always be available in all places), and the inconvenience of storing the vacuum apparatus have surely reduced their commercial success. In today's busy environment, most people apparently find vacuum sealing food in a storage device using prior art systems simply more trouble than it is worth.

Notably, often times only a relatively short term vacuum sealed container, that is low cost, quick, convenient and easy to achieve is all that is required to prolong the freshness of food stuff. For example, one may purchase bread, perhaps originally vacuum packed from the bread supplier where such bread is not typically completely consumed at one time but will be eaten over a period of a few days. Such bread goes stale quickly once opened as it is no longer under vacuum. A relatively short term vacuum sealed container that is quick, lost cost, convenient, and easy to achieve would be helpful in maintaining the freshness of such bread and would be more likely to be used by the public.

What is needed is a storage device, such as a re-sealable baggie, with an integral low cost system of evacuating the air from the baggie that does not require a vacuum apparatus.

Additionally, food stuff almost always comes in some type of somewhat resealable packaging, particularly where the food stuff is not generally completely consumed upon the initial opening of such original packaging. Bread, for example, often comes in its own baggie. Similarly, snacks, such as potato chips, frequently come in a baggie type container. Further, such baggies, even if re-sealable, do not include an apparatus or method for generating a vacuum inside such baggie after re-sealing.

What is further needed is a low cost and convenient vacuum apparatus that may be associated with such original packing/containers as well as commercially available re-sealable storage devices such as baggies without vacuum sealing features and more ridged containers (such as plastic containers) where such vacuum apparatus is used to generate a vacuum within such storage devices.

SUMMARY

Objects and advantages of the invention will be set forth in the following description, or may be obvious from the description, or may be learned through practice of the invention.

Broadly speaking, a principal object of the present invention is to provide a method and apparatus for creating a vacuum seal in a standard food container.

Another general object of the present invention is to provide an apparatus for creating a vacuum seal in a zip lock baggie.

Yet another general object of the invention is to provide a collapsible baggie storage device with an integral vacuum sealing feature that does not require the use of external devices to vacuum seal the storage device.

Another general object of the present invention is to provide a retrofit-kit configured to provide standard food storage containers with vacuum sealing features where the use of external devices to vacuum seal the storage device is not required.

Additional objects and advantages of the present invention are set forth in, or will be apparent to those skilled in the art from, the detailed description herein. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
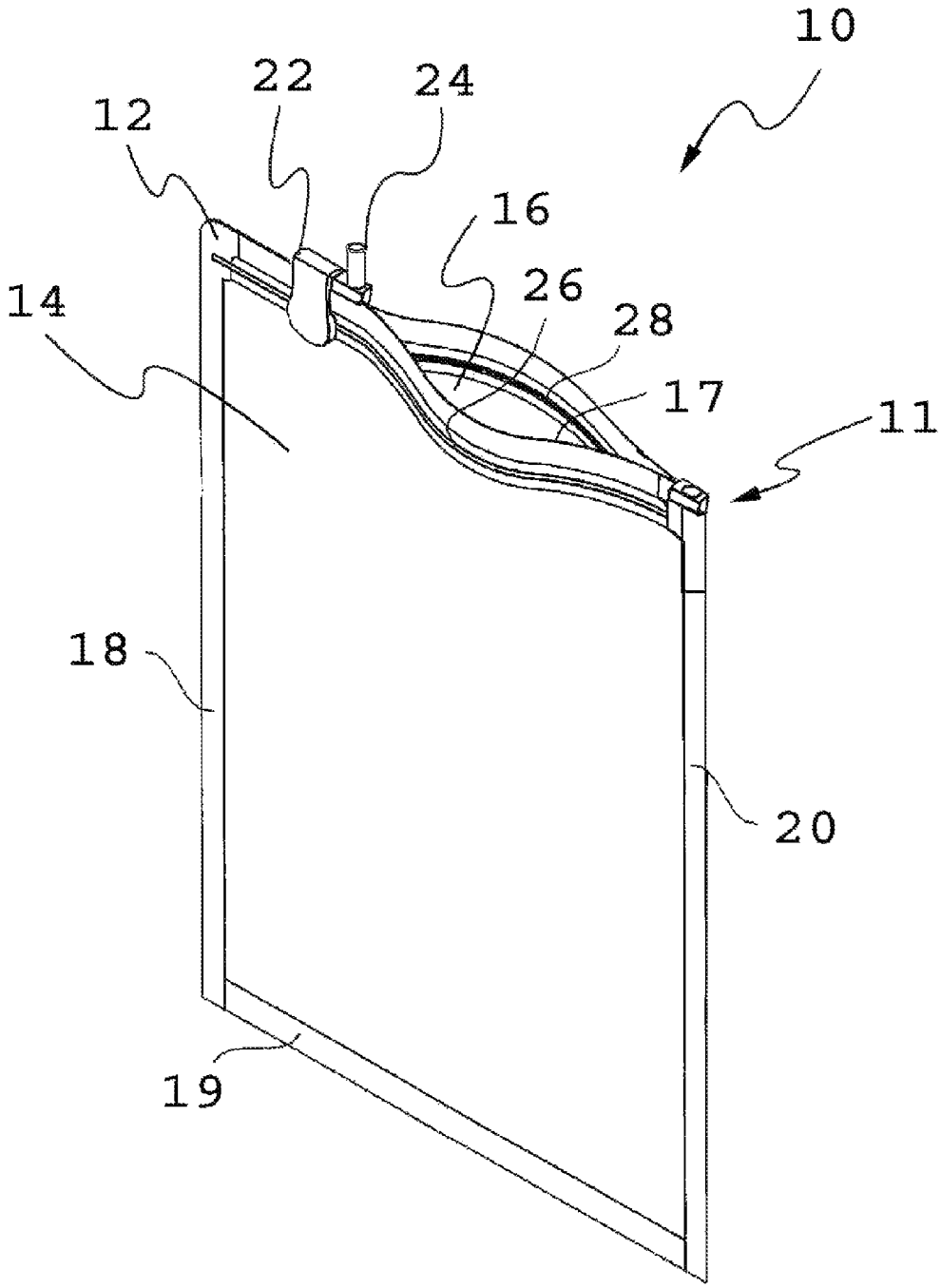
FIG. 1 is a side perspective view of one embodiment of a vacuum storage device comprising an integral vacuum portal and a slide configured with a vacuum portal interface.
Figure 2:
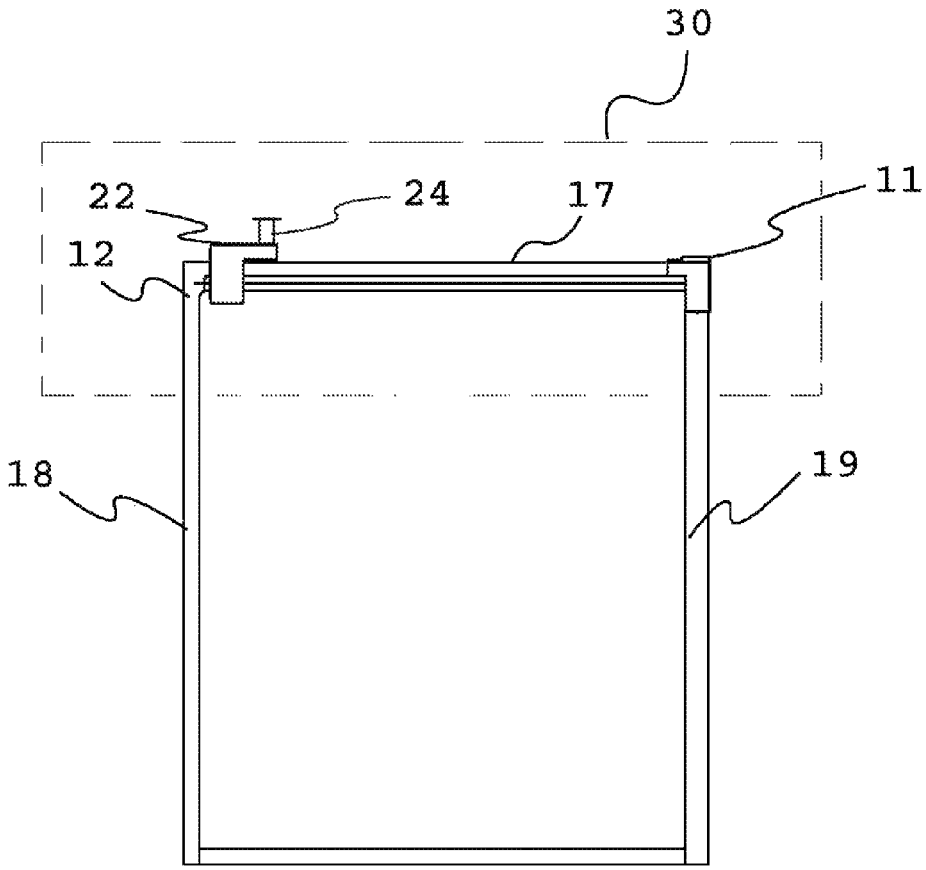
FIG. 2 is a side view of the vacuum storage device depicted in FIG. 1.
Figure 3:
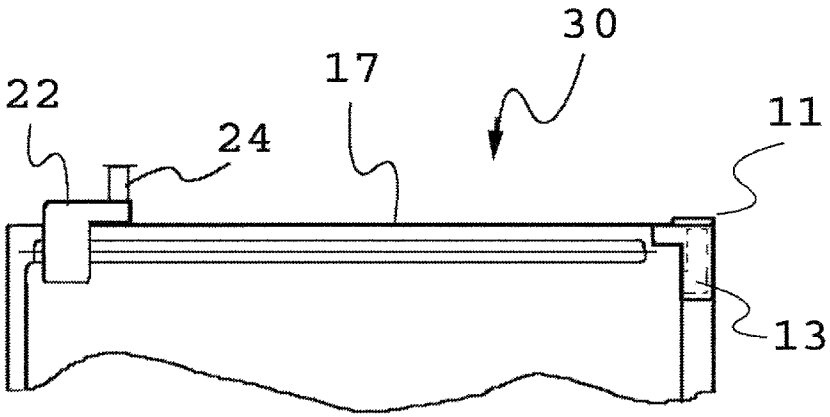
FIG. 3 is a close up side view the vacuum portal and slide depicted in FIG. 1.

Repeat use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

For the purposes of this document two or more items are "associated" by bringing them together or into relationship with each other in any number of ways including a direct or indirect physical connection that may be a permeate connection, a temporary or releasable connection, a ridged connection or a connection that allows relative movement between the items being associated with each other.

This document contains headers. Such headers are "place markers" inserted for the convenience of a reader and have no other meaning or effect on the construction of this document in any way and should not to be used in the construction of this document.

While the particulars of the present invention and associated technology may be adapted for vacuum sealing any type container for storing any type of item, the examples discussed herein are primarily in the context of vacuum storage devices for storing food stuff.

Referring now to FIG. 1 through FIG. 4, various views of one exemplary embodiment of storage apparatus (10) comprising integral vacuum portal (11) and portal interface (24) is presented. For such currently preferred embodiment, storage apparatus (10) comprises a re-sealable storage bag (12) defining a first sheet (14) mechanically associated with an opposing second sheet (16) along edges 18, 19, and 20 thereby defining a storage bag having a storage space. For such embodiment, the mechanical association between first sheet (14) and second sheet (16), along edge 18, edge 19, and edge 20, is "bonded" and not easily unbounded. In contrast, the fourth edge (17) defines a releasable and substantially air tight association using a zip lock configuration such as a male rail (26) and female groove (28) configuration. Other well-known air tight releasable associations for edge (17), such as the one's made by Zip® Bags, ZipLoc®, and Glad® may be used without departing from the scope and spirit of the present invention. For the currently preferred embodiment, when slider (22) is moved along edge (17), from the bag open position ("L" in FIG. 4) to bag closed position ("R" in FIG. 4), male rail (26) releasably associates with female groove (28) to form a substantially air tight seal between male rail (26) and female groove (28). Once closed, access to the inside of storage apparatus (10) is provided by vacuum portal (11) via portal interface (24).

Figure 4:
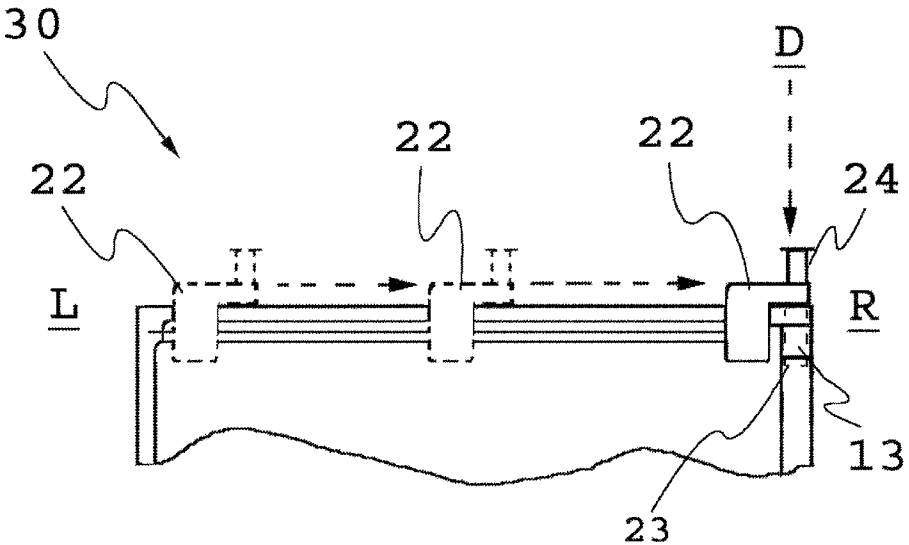
FIG. 4 is a close up side view of the vacuum portal and slide of FIG. 3 with phantom images depicting the slide in different locations along the seal line.

One of ordinary skill in the art will appreciate that when slider (22) has been moved to the far right position ("R") as depicted in FIG. 4, portal interface (24) is in alignment with vacuum port (11). For one embodiment, at least part of vacuum portal (11) defines a cylindrical hollow tube defining a vacuum portal diameter. The vacuum portal (11) further defines an access point (13) to the inside of storage apparatus (10). Similarly, portal interface (24) defines a hollow cylindrical tube defining an interface outside diameter that is slightly less than the vacuum portal inside diameter so that portal interface (24) may be pushed down into vacuum portal (11).

For the currently preferred configuration, the portal interface (24) is pushed toward vacuum portal (11) just far enough to access vacuum portal (11) so that the portal interface (24) is partially inside vacuum portal (11). A user then places the free end of portal interface (24) in his mouth and evacuates the air from storage device (10) via access port (13) by applying a vacuum pressure using his lungs. When the desired level of air evacuation is achieved, portal interface (24) is then pushed all the way into vacuum portal (11) so that the distal end of portal interface (24) extends beyond access port (13) to point (23) so that the side wall of portal interface (24) blocks access port (13) thereby sealing vacuum portal (11) and creating a substantially air tight vacuum seal inside storage device (10). Notably, one of ordinary skill in the art will appreciate that for such a configuration, pushing portal interface (24) into vacuum portal (11) provides the additional benefit of locking slide (22) in the closed ("R") position.

In addition to the seal provided by portal interface (24), vacuum portal (11) may further define a normally closed or normally open seal. For one embodiment, access port (13) is configured to define a normally closed opening that is configured to open upon applying a light pressure (using fingers) in the appropriate manner to access port (13). Such a configuration provides an additional seal. Alternatively, for yet another embodiment, portal interface (24) does not provide a sealing function and a normally closed seal provided by vacuum portal (11) is the only seal.

Alternatively, for the normally open embodiment, access port (13) defines a normally open passage that may be closed by applying a light pressure to access port (13). This allows a user to momentarily seal vacuum portal (11) while making a primary seal with portal interface (24).

For yet another alternative embodiment, portal interface (24) is not associated with slider (22). For such alternative embodiment, portal interface (24) is either mechanically associated with vacuum portal (11) or forms one integral part with vacuum portal (11) and slider (22) is simply used to seal edge (17).

Vacuum Extension

Figure 5:
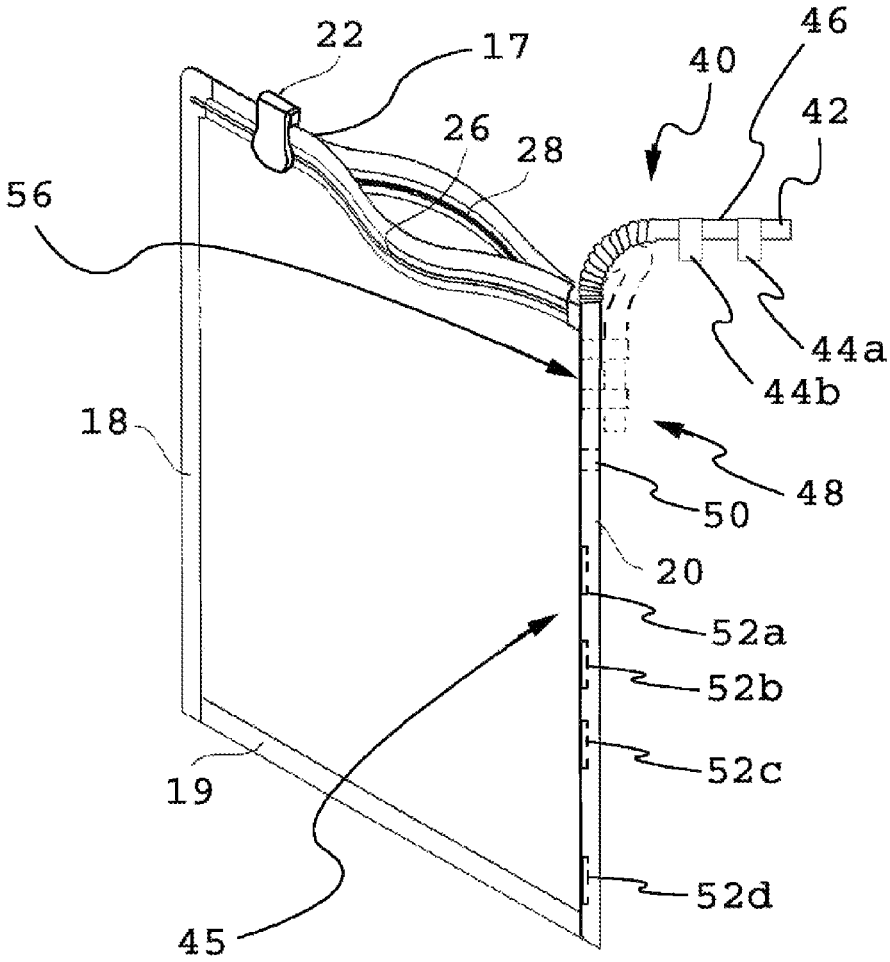
FIG. 5 is a side perspective view of one embodiment of a vacuum storage device comprising an integral vacuum portal with self-locking portal interface.

Reference is now made to an alternative exemplary embodiment depicted in FIG. 5. For such configuration, the storage device (10) comprises a re-sealable storage bag (12) as described above defining a first sheet (14) mechanically associated with an opposing second sheet (16) along edges 18, 19, and 20. The fourth edge (17) defines a releasable and substantially air tight association using a zip lock configuration such as a male rail (26) and female groove (28) configuration. As before, other well-known air tight releasable associations for edge (17), such as the one's made by Zip® Bags, ZipLoc®, and Glad®, may be used without departing from the scope and spirit of the present invention.

For one preferred embodiment, at least one of (a) at least one edge and (b) a sheet defines an integral vacuum portal (40) comprising extension (42). For the currently preferred embodiment, edge (20) defines integral vacuum portal (40) comprising extension (42). For one embodiment, extension (42) is a cylindrical extension (42) defining a short straw section comprising means for selectively sealing and unsealing the extension (42). The sealing means may be a one way valve, such as a ball valve, allowing air flow out of extension (42) but not into the extension (42). Other sealing means include a clamp for pinching off all air flow through extension (42).

FIG. 5 presents one possible alternative embodiment comprising a cylindrical extension (42) defining a tube with a flexible section comprising a plurality of circumferential grooves. One end of said flexible section is associated with a first straight resilient section (46) (which may be collapsible but returns to its original shape after the collapsing force is removed—much like the technology used for making drinking straws). The opposing second end of the flexible section is associated with a lower straight section (45) defined by or associated with edge (20). Lower straight section (45) may be rigid or collapsible and resilient. Notably, the various extension sections may be rigid, flexible, collapsible and resilient as desired.

For the presently preferred embodiment, lower straight section (45) defines a collapsible tube, much like a straw, comprising at least one access port (52) that provides access to the inside of storage device (10) via the free end of cylindrical extension (42). For one embodiment, disposed between the upper most access port (52*a*) and clasping section (56)

(described in detail later) is access valve (50). For such embodiment, access valve (50) is a normally closed valve structure that may be opened by simply applying a light pinching pressure to access valve (50), perhaps using fingers, thereby providing access to the inside of storage device (10) via ports (52*a*-52*d*) and the free end of cylindrical extension (42).

As depicted in FIG. 5, cylindrical extension (42) further defines at least one clasping device (44) configured to associate with the clasping section (56) of edge (20) at some point above access valve (50) and below the flexible section of the cylindrical extension (42). For the current embodiment, cylindrical extension (42) is associated with two clasping devices, clasping device (44*a*) and clasping device (44*b*) referred to collectively as clasping device (44). Clasping device (44) are configured to pinch off lower straight section (45) by folding the free end of cylindrical extension (42) so that the at least one clasping device (44) is associated with the lower straight section (45) thereby releasably clasping and pinching off clasping section (56).

It will be appreciated that while the exemplary embodiment depicted in FIG. 5 shows a lower straight section (45) that runs substantially the entire length of edge (20), other embodiments where lower straight section (45) runs less than the entire length of edge (20) fall within the scope and spirit of the present invention.

Vacuum Seal Accessory

Figure 6:
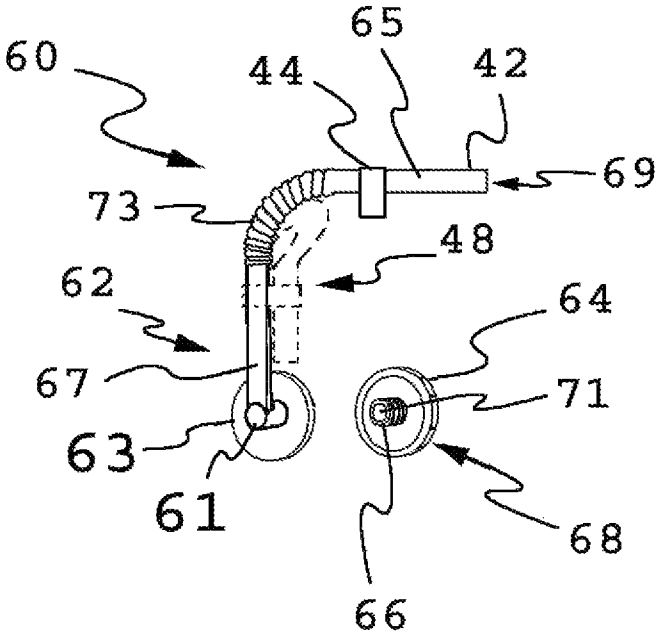
FIG. 6 is a side perspective view of a vacuum portal kit configured for being associated with packages configured for holding food stuff.
Figure 7:
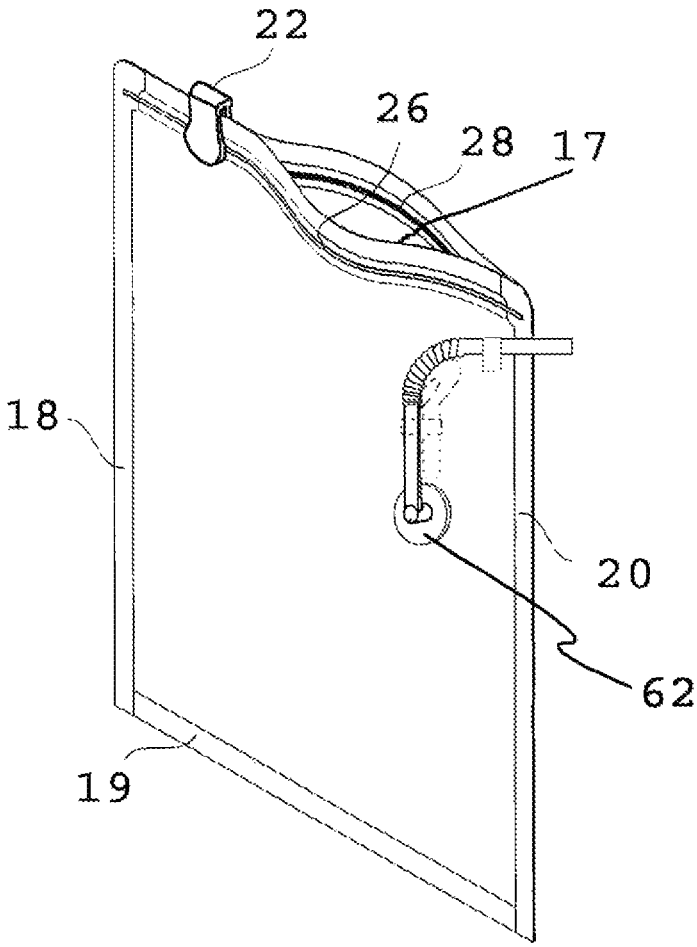
FIG. 7 is a side perspective view of the vacuum portal kit depicted in FIG. 6 associated with a prior art baggie.

Referring now to FIG. 6 and FIG. 7, one exemplary embodiment of a vacuum seal accessory (60) configured for being associated with a food storage device is presented. As presented in FIG. 6, for the current embodiment, vacuum seal accessory (60) comprises an outer member (62) configured for being mechanically associated with an inner member (64). For the currently preferred embodiment, outer member (62) comprises an outer member port-interface (63) defining a circular disk with a vacuum conduit (61) running through the approximate center. Similarly, inner member (64) defines a circular disk comprising a plurality of access ports (68) all in fluid communication with vacuum port (66) disposed in the approximate center of such circular disc. Preferably the diameter of the circular disk defined by inner member (64) is substantially equal to the diameter of the circular disk defined by outer member port-interface (63).

As depicted in FIG. 6, vacuum port (66) defines a hollow male threaded cylinder defining a vacuum port diameter that is less than the diameter of the circular disk defined by inner member (64). Similarly, vacuum conduit (61) defines a female threaded cylindrical opening with a diameter suitable for receiving a male threaded vacuum port (66). One of ordinary skill in the art will appreciate that when the vacuum port (66) is threaded into vacuum conduit (61), vacuum conduit (61) will be in fluid communication with access ports (68).

Outer member (62) further comprises a hollow extension (42) (as described above) which may be either an integral component of outer member port-interface (63) or a separate component mechanically associated with outer member port-interface (63). For the current embodiment, hollow extension (42) defines a cylindrical tube comprising a flexible region (73) disposed between a first straight region (65) and a second straight region (67) that is an integral component of outer member port-interface (63). For one alternative embodiment, outer member port-interface (63) defines an extension interface configured for receiving a hollow extension (42) that is a separate component from outer member port-interface (63). For such embodiment, hollow extension (42) may define a common drinking straw.

As described above for hollow extension (42), either or both of first straight region (65) and second straight region (67) may define a resilient collapsible section that may be pinched off to prevent fluid flow when a sufficient pinching force is applied to such section(s) where such section(s) return to their original shape after the collapsing/pinching force is removed. As before, the various extension sections/regions may be completely or partially rigid, flexible, collapsible and/or resilient as desired.

For the presently preferred embodiment, second straight region (67) defines a collapsible tube, much like a straw. As depicted in FIG. 6, extension (42) further defines at least one clasping device (44) configured to releasably associate with and pinch off second straight region (67) as depicted by phantom image (48).

From the above, one of ordinary skill in the art will appreciate that when vacuum port (66) is threaded into vacuum conduit (61), and clasping device (44) is not associated with and pinching off second straight region (67), the access ports (68) will be in fluid communication with the free end (69) of extension (42).

As described above, an additional one way access valve may be disposed along any part of extension (42) but preferably between the second straight region (67) pinch point and vacuum conduit (61). Further, vacuum conduit (61) may define a one way valve (such as a ball valve) that prevents fluid movement from extension end (69) to vacuum conduit (61) but permits flow from vacuum conduit (61) to extension end (69). Alternatively, for one embodiment there are no clasping devices (44) and only a one way valve defined by at least one of extension (42), vacuum conduit (61), and inner member (64).

FIG. 7 depicts a vacuum seal accessory (60) mechanically associated with one sheet of a re-sealable storage bag not otherwise configured for providing a vacuum seal. To install accessory (60), a small hole or slit, preferably having a length shorter than the outer diameter defined by vacuum port (66), is cut in one sheet of a storage bag so that vacuum port (66) [a male threaded hollow cylinder as described above] may be inserted through such hole, from the insides side of the bag, so that vacuum port (66) is inside the storage bag when the storage bag is closed. Next, from the opposing side of the sheet, (i.e. outside of the bag), the cylindrical female threaded opening defined by vacuum conduit (61) is aligned with vacuum port (66) which is then threaded into vacuum conduit (61). It should be appreciated that while threads are used to mechanically associate vacuum conduit (61) with vacuum port (66), other suitable technologies may be used such as snapping configuration and twist locks and the like.

One of ordinary skill in the art will appreciate that when the vacuum port (66) is threaded into vacuum conduit (61) as described above, free end (69) of extension (42), on the outside of the storage bag, will be in fluid communication with access ports (68) disposed within the storage bag.

Vacuum Seal Accessory with Snap Valve

Figure 8:
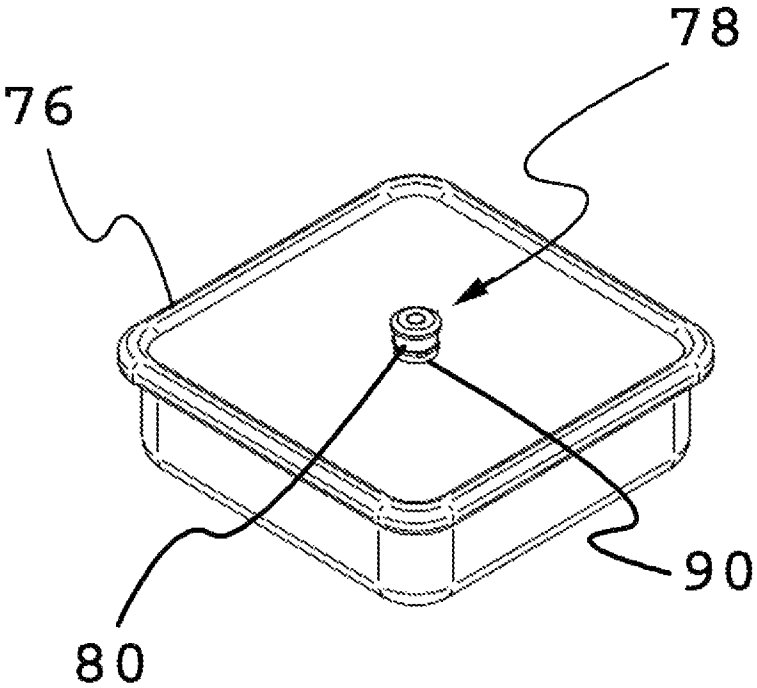
FIG. 8 is an elevated side perspective view of a storage container retrofitted with a vacuum seal accessory.

Referring now to FIG. 8-FIG. 13, one exemplary embodiment of a vacuum seal accessory with a snap valve seal is presented. FIG. 8 depicts vacuum seal accessory (78) associated with the top of a storage container (76). Storage container (76) may be any type of container configured for storing food stuff and for providing an air tight seal and with little or no means for removing air from container (76) once sealed.

Container (76) may be a zip lock baggie as described above or a more rigid plastic container such as the one depicted for storage container (76) in FIG. 8.

Valve Cap

Figure 10:
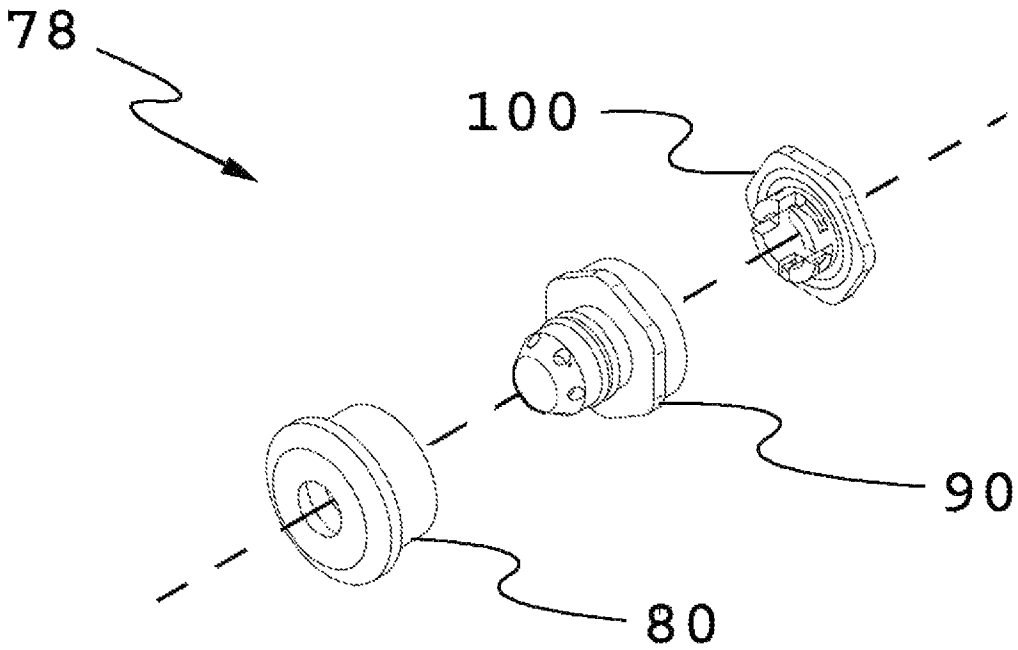
FIG. 10 is an a side perspective exploded view of a vacuum seal accessory depicted in FIG. 8.

FIG. 10 shows an exploded view of vacuum seal accessory (78) comprising a valve cap (80), an outer member (90), and an inner member (100). Preferably, a valve cap (80), outer member (90), and an inner member (100) are each formed as monolithic thermoplastic components using any suitable method including well known injection molding techniques. Such components may be formed of various materials including polypropylene and/or any other suitable materials.

Figure 9A:
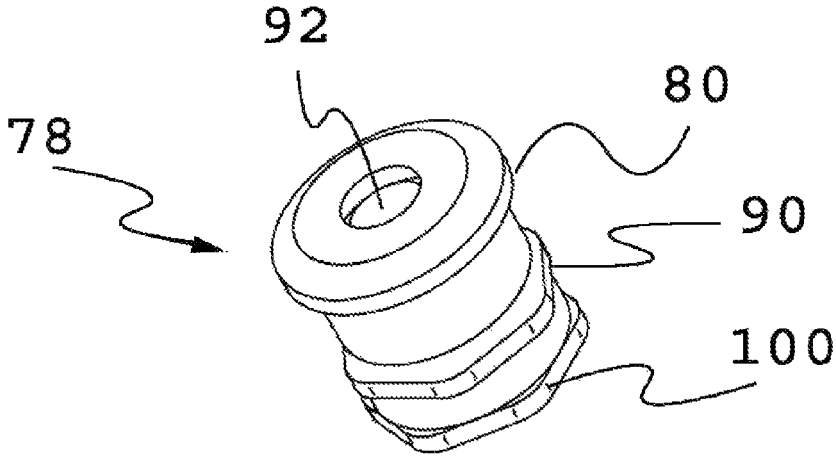
FIG. 9*a* is a side perspective view of a vacuum seal accessory in an open position.
Figure 9B:
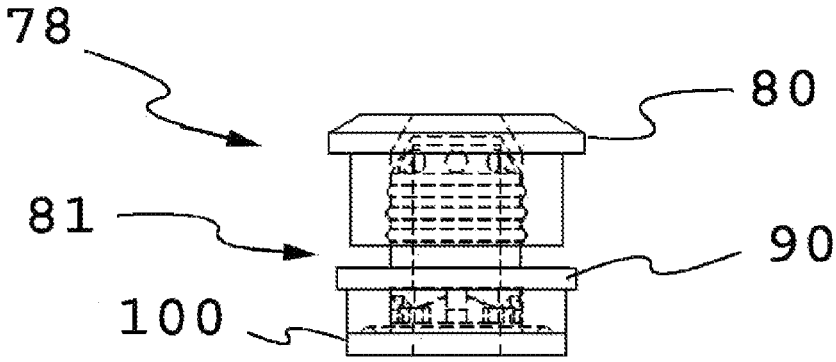
FIG. 9*b* is a side view of the vacuum seal accessory depicted in FIG. 9*a;*
Figure 9C:
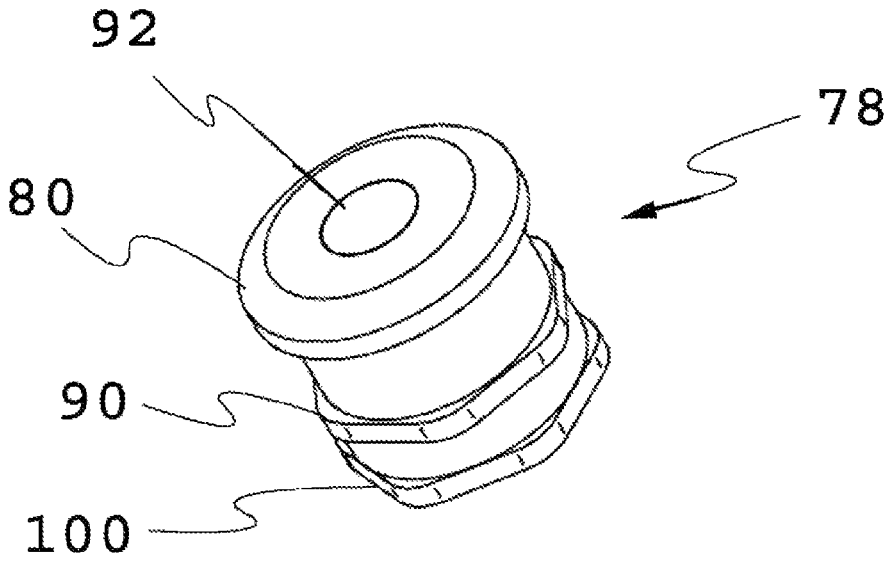
FIG. 9*c* is a side perspective view of a vacuum seal accessory in a closed position.
Figure 9D:
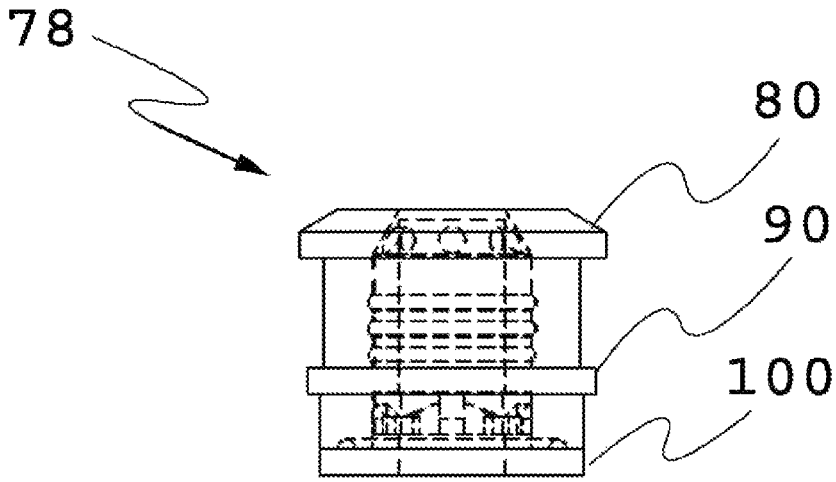
FIG. 9*d* is a side view of the vacuum seal accessory depicted in FIG. 9*c;*

FIG. 9*a* and FIG. 9*b* depict the vacuum seal accessory (78) in an open position where valve cap (80) is pulled away from outer member (90) thereby creating gap (81) (FIG. 9*b*) and providing access to ports (94) (FIG. 12*a*) (described in more detail later). Similarly, FIG. 9*c* and FIG. 9*d* depict the vacuum seal accessory (78) in a closed position where valve cap (80) is pushed toward outer member (90) thereby eliminating or reducing gap (81) and sealing ports (94) (FIG. 12*a*).

Figure 11A:
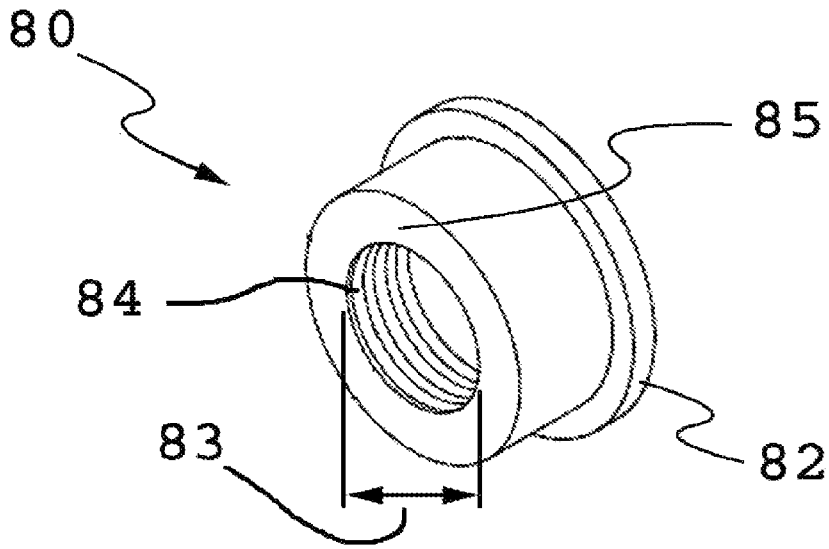
FIG. 11*a* is a rear perspective view of a vacuum seal accessory top cap.
Figure 11B:
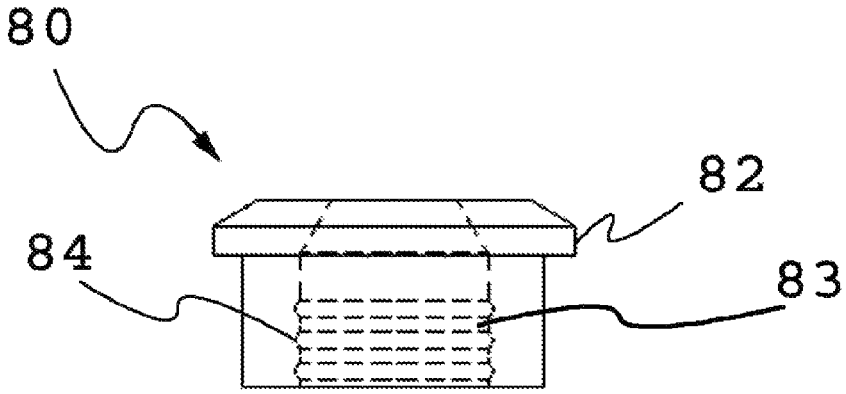
FIG. 11*b* is a side view of a vacuum seal accessory top cap.

Referring now to FIG. 11*a* and FIG. 11*b*, one exemplary embodiment of a valve cap (80) is presented. Valve cap (80) defines a hollow cylindrical body structure defining an inside cap diameter (83) with a frusto-conical shaped annular cap section (82). At the opposing end of valve cap (80) cap interface (85) is defined. It will be appreciated that while annular cap section (82) defines a frusto-conical shape, any suitable shape may be used. Similarly, while the annular surface of the cap interface (85) illustrated in FIG. 11*a* is planar, such interface may alternatively have a frusto-conical or other suitable shape.

At least one annular latching member (84) extends annularly around the inside surface of valve cap (80). For the current embodiment, there are three annular latching members (84) disposed adjacent and running parallel to each other and separated by latching member gap (83). Such latching members (84) are configured for being movably associated with similar latching members defined by our member (90) and as will be described below.

Outer Member

Figure 12B:
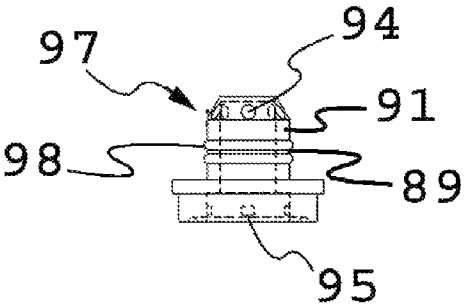
FIG. 12*b* is a side view of a vacuum seal accessory outer member.
Figure 12A:
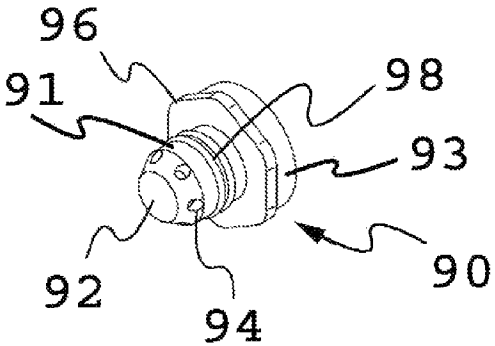
FIG. 12*a* is a side perspective view of a vacuum seal accessory inner member.
Figure 12C:
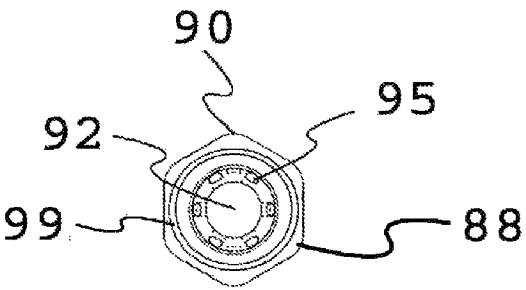
FIG. 12*c* is a bottom view of a vacuum seal accessory outer member.
Figure 13A:
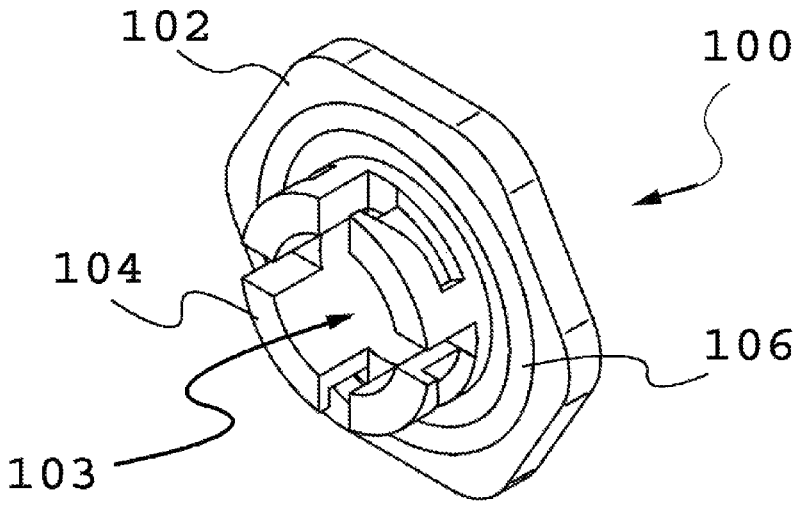
FIG. 13*a* is a side perspective view of a vacuum seal accessory inner member.
Figure 13B:
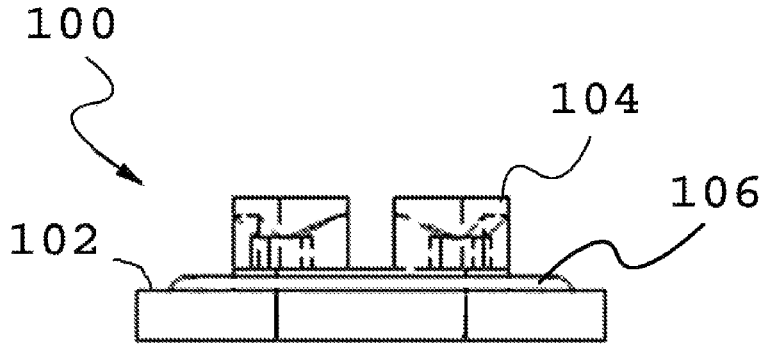
FIG. 13*b* is a side view of a vacuum seal accessory inner member.

FIG. 12*a*, FIG. 12*b*, and FIG. 12*c* present one exemplary embodiment of outer member (90). Outer member (90) is referred to as the "outer member" as it is configured for being associated with an outside surface of a storage container. For the currently preferred embodiment, outer member (90) comprises a head section (93) and integral depending conduit section (91). Heads section (93) defines a hollow cylindrical body in the approximate center of head section (93). Similarly, depending conduit section (91) defines a hollow cylindrical body defining a first end associated with head section (93) and with the free distal end (92) being closed (i.e. the cylindrical tube is closed at one end defining a "blind" cylinder). Depending conduit (91) defines an outside diameter that is less than inside cap diameter (83) (FIG. 11*a*) of valve cap (80). The first end of depending conduit (91) in alignment with the hollow cylindrical body defined by head section (93) thereby placing the depending conduit (91) in fluid communication with the opening defined by head section (93).

Disposed between distal end (92) and head section (93) is at least one port (94). As depicted in FIG. 12*a*-12*c*, for the current embodiment there are a plurality of ports (94) disposed along port zone (97). For the preferred embodiment, port zone (97) is located at the distal end (92) of depending conduit section (91) and defines a frusto-conical shape suitably sized and configured for mating with the previously described frusto-conical shaped annular cap section (82). One of ordinary skill in the art will appreciate that the at least one port (94) will be in fluid communication with head section (93) through depending conduit section (91).

As depicted in FIG. 12*a*-12*c*, disposed between the port zone (97) and the head section (93) is at least one annular conduit latching member (98) which extends annularly around the outside of depending conduit section (91). For the currently preferred embodiment, there are two conduit latching members (98) disposed adjacent and running parallel to each other and separated by conduit latching member gap (89). The width of each conduit latching member (98) is slightly less than the annular latching member gap (81) so that a conduit latching member may fit into annular latching member gap (81). Similarly, the width of each annular latching member (84) is slightly less than the conduit latching member gap (89) so that an annular latching member (84) may fit into a conduit latching member gap (89). Thus, an alternating movable latching configuration can be achieved between the two latching members that may be shifted by pulling or pushing (as required depending on the open/closed status) on valve cap (80) until adjacent latching members shift by one or more gaps.

As depicted in FIG. 12*c*, head section (93) further defines a planar outer member interface (88). The outer perimeter of outer member interface (88) defines an octagon pattern. Outer member interface (88) further defines annular sealing ring (99) configured for being associated with and forming a seal with a surface of a storage container. Head section (93) further defines a plurality of locking tabs (95) configured for being mechanically associated with tab receivers (104) defined by inner member (100) as described below.

Inner Member

Inner member (100) defines a planar inner member interface (102) defining a hole (103) there through in the approximate center. Along the perimeter of the hole (103) are a plurality of locking receivers (104) extending perpendicularly from the planar inner member interface (102) and configured for receiving locking tabs (95) defined by outer member (90). Inner member interface (102) further defines annular sealing ring (106) disposed between the outer perimeter of inner member interface (102) and a plurality of locking receivers (104). Inner member interface (102) and annular sealing ring (106) are configured for being associated with and forming a seal with a surface of a storage container in a similar manner as annular sealing ring (99).

For the preferred embodiment, the outer perimeter of inner member interface (102) defines an octagon shape substantially equal in size and length as the octagon shape defined by outer member interface (88). Similarly, the diameter of annular sealing ring (99) is substantially equal to the diameter of annular sealing ring (106).

For one alternative embodiment, the locking tab (95) and locking receiver (104) embodiment is replaced by other suitable connecting means such as threads. For such threaded embodiment, head section (93) defines female threads instead of locking tabs (95). Similarly, inner member (100) defines a male threaded cylinder instead of locking tab receivers (104) wherein such male threaded cylinder is configured for being associated with the female threads defined by head section (93). Such a configuration better compensates for different thicknesses between different storage containers.

Associating Valve Cap with Outer Member

Since the outside diameter of depending conduit section (91) is less than the inside cap diameter (83) of valve cap (80), valve cap (80) is movably associated with outer member (90) by inserting depending conduit section (91) into valve cap (80) until the frusto-conical shaped port zone (97) is mating with and sealed by the frusto-conical shaped annular cap section (82) as depicted in FIG. 9*c* and FIG. 9*d* thereby defining a closed position. Notably, valve cap (80) will be secured in such position by the movable mechanical association between annular latching members (84) and conduit latching members (98).

To move the valve cap (80) to an open position as depicted in FIG. 9*a* and FIG. 9*b*, with outer member (90) being held in position, a pulling force is applied to valve cap (80) until adjacent latching members are moved one or more positions until the frusto-conical shaped port zone (97) is no longer mating with nor being seal by the frusto-conical shaped annular cap section (82) thereby defining an open position. When in an open position, open position, the opening defined by the end of valve cap (80) will be in fluid communication with inner member (100) via ports (94), depending conduit section (91), and the cylindrical opening defined by head section (93).

Associating Outer Member (90) and Inner Member (100) with a Storage Container To associate the inner member (100) and outer member (90) with a storage container, a hole is made in a surface of a storage container having a diameter that larger than the diameter to hole (103) [plus the thickness of the locking tab receivers] but less than the diameter of annular sealing ring (106). From the inside of the container (or on the inside side of a container surface), the perpendicularly extending locking tab receivers (104) (or the threaded hollow cylinder depending on the embodiment) is inserted through such hole and mechanically associated with outer member (90). For the locking tab/locking receiver configuration, outer member (90) is rotated until locking tabs (95) are being received by the locking receivers (104) thereby establishing an airtight seal between outer member (90), the storage container, and inner member (100). For the thread embodiment, the threaded cylinder defined by inner member (100) is threaded into outer member (90) until he airtight seal is formed as described above. One of ordinary skill in the art will appreciate that such a configuration places the free end of valve cap (80) in fluid communication with the inside of such storage container so that air may be evacuated from such storage container and the evacuated container sealed.

While the present subject matter has been described in detail with respect to specific embodiments thereof, it will be appreciated that those skilled in the art, upon attaining an understanding of the foregoing may readily adapt the present technology for alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A storage bag with a vacuum sealing function, said storage bag comprising:

a storage bag defining a storage space and comprising an bag-opening for accessing said storage space;

a sealing mechanism associated with said bag-opening wherein said sealing mechanism comprises a male rail and female groove configuration configured to releasably seal said bag-opening to form a substantially air tight seal;

a slider movably associated with said sealing mechanism wherein said slider is configured to slide across said sealing mechanism in a first direction to a sealed-position to engage said sealing mechanism and wherein said slider is further configured to slide across said sealing mechanism in a second direction to a unsealed-position to disengage said sealing mechanism;

a portal associated with said storage bag wherein said portal provides a fluid flow path to said storage space;

a portal interface associated with said slider wherein said portal interface is configured to provide a fluid flow path from outside said storage space to said portal and wherein said portal interface is configured to allow a user to evacuate air from said storage area; and wherein said portal interface is associated with said slider and is configured to selectively block the flow of fluid through said portal when pushed into said portal thereby providing a flow blocking function and a slider locking function.

2. A storage bag with a vacuum sealing function as in claim 1, wherein said portal interface is associated with said slider and wherein said portal is disposed at said sealed-position so that said portal interface is in alignment with said portal when said slider is moved to said sealed-position.

3. A storage bag with a vacuum sealing function as in claim 1, wherein:

said portal defines a generally cylindrical portal-tube defining a portal diameter and wherein said portal further defines an access port that provides a flow path to said storage space;

said portal interface is movably associated with said slider;

said portal interface defines a portal-extension wherein at least part of said portal-extension defines a generally cylindrical tube having a diameter less than said portal diameter and wherein said portal-interface further defines a free end distal from said slider;

said portal is disposed at said sealed-position so that said portal interface is in alignment with said portal when said slider is moved to said sealed-position thereby placing said free end in fluid communication with said storage area; and wherein said portal interface is configured to be received by said portal to block said access port thereby defining said flow blocking function.

4. A storage bag with a vacuum sealing function as in claim 3, wherein said portal extension locks said slider at the sealed-position when said portal extension is received by said portal.

5. A storage bag with a vacuum sealing function as in claim 1, wherein said portal defines a generally cylindrical portal-tube defining a portal diameter and wherein at least a portion of said portal interface defines a generally cylindrical tube having a diameter less than said portal diameter and wherein said portal interface extends beyond the perimeter of said storage bag thereby defining a portal interface folding portion and a portal interface distal end thereby defining a flow path from said distal end to said storage space when said folding section is not folded and wherein said folding section defines said blocking function when folded.

6. A vacuum storage bag, said vacuum storage bag comprising:

a storage bag defining a storage space and comprising an bag-opening for accessing said storage space;

a sealing mechanism associated with said bag-opening wherein said sealing mechanism comprises a zip lock male rail and female groove configuration configured to releasably seal said bag-opening to form a substantially air tight seal;

a portal associated with said storage bag wherein said portal defines a generally cylindrical portal-tube defining a portal diameter and further defining an access port that provides a fluid flow path to said storage space;

a portal interface defining a generally cylindrical tube having a diameter less than said portal diameter wherein said portal interface is one of (a) configured to be selectively and releasably received by said portal thereby defining a fluid flow path from outside said storage space to said portal and (b) integral to said portal and configured to extend beyond the perimeter of said storage bag to a portal interface distal end thereby defining a fluid flow path from outside said storage space to said portal;

wherein said portal interface is configured to allow a user to evacuate air from said storage area; and wherein said portal interface is configured to be selectively and releasably received by said portal to block said access port thereby defining a flow blocking function.

7. A vacuum storage bag as in claim 6, wherein said portal interface is integral to said portal and wherein at least a portion of said portal interface is configured to be selectively folded to block the flow path from said distal end to said portal thereby defining a flow blocking function.

8. A vacuum storage bag as in claim 6, wherein said portal defines a normally closed valve configured to prevent fluid flow through said portal when not actuated and to allow fluid flow through said portal when actuated.

9. A vacuum storage bag as in claim 6, where said access port defines a normally closed passage that may be opened by applying a light pressure to access port.

10. A vacuum storage bag as in claim 6, further comprising a slider movably associated with said sealing mechanism wherein said slider is configured to slide across said sealing mechanism in a first direction to a sealed-position to engage said sealing mechanism and wherein said slider is further configured to slide across said sealing mechanism in a second direction to a unsealed-position to disengage said sealing mechanism.

11. A vacuum storage bag as in claim 10, wherein said portal interface is movably associated with said slider and wherein said portal is disposed at said sealed-position so that said portal interface is in alignment with said portal when said slider is moved to said sealed-position.

12. A vacuum storage bag as in claim 11, wherein said portal extension locks said slider at the sealed-position when said portal extension is being received by said portal.

13. A vacuum storage bag as in claim 11, wherein the external perimeter of said storage bag defines a rectangle suitably sized to receive a loaf of bread.

14. A vacuum storage bag as in claim 13, wherein said external perimeter defines only two opposing edges wherein said bag-opening is defined at one edge and wherein the opposing edge is sealed.

15. A vacuum storage bag as in claim 6, wherein said external perimeter defines four edges and wherein said bag-opening is defined along a first-edge and wherein said portal is defined at one corner of said first-edge and wherein the remaining three edges are sealed.

16. A vacuum baggie configured for storing items, said vacuum baggie comprising:

a storage baggie defining a storage space wherein said storage baggie defines three sealed edges and one open edge defining a first corner an and opposing second corner thereby defining a bag-opening for accessing said storage space;

a sealing mechanism associated with said bag-opening between said first corner and said second corner wherein said sealing mechanism comprises a zip lock male rail and female groove configured to releasably seal said bag-opening to form a substantially air tight seal;

a slider movably associated with said sealing mechanism wherein said slider is configured to slide across said sealing mechanism in a first direction to a sealed-position defined at said first corner to engage said sealing mechanism and wherein said slider is further configured to slide across said sealing mechanism in a second direction to a unsealed-position positioned at said second corner to disengage said sealing mechanism;

a portal defining a generally cylindrical portal-tube defining a portal diameter, said portal disposed at said first corner and configured to provide a fluid flow path to said storage space;

a portal interface associated with one of (a) said slider and (b) said portal;

wherein at least a portion of said portal interface defines a generally cylindrical tube having a diameter less than said portal diameter and wherein said portal interface is configured to provide a fluid flow path from outside said storage space to said portal and further configured to allow air evacuation from said storage area; and wherein at least one of (a) said portal is configured to selectively block the flow of fluid through said portal thereby providing a flow blocking function to maintain said air tight seal after evacuating air from said storage area and (b) said portal interface is configured to be removably pushed into said portal to selectively block the flow of fluid through said portal thereby providing a flow blocking function to maintain said air tight seal after evacuating air from said storage area.

17. A vacuum baggie configured for storing items as in claim 16, wherein the perimeter of said storage baggie defines the general shape of a loaf of bread when said baggie is full.

18. A vacuum baggie configured for storing items as in claim 16, wherein said portal interface is associated with said slider and wherein said portal is disposed at said first corner so that said portal interface is in alignment with said portal when said slider is moved to said sealed-position.

19. A vacuum baggie configured for storing items as in claim 18, wherein said portal extension locks said slider at the sealed-position when said portal extension is received by said portal.

* * * * *